US008388370B2

(12) United States Patent
Yamaji et al.

(10) Patent No.: US 8,388,370 B2
(45) Date of Patent: Mar. 5, 2013

(54) CONNECTOR ASSEMBLY WITH GROUNDING SHIELD

(75) Inventors: Takahiro Yamaji, Tokyo (JP); Koji Hayashi, Tokyo (JP); Takeshi Shindo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 23 days.

(21) Appl. No.: 13/028,468

(22) Filed: Feb. 16, 2011

(65) Prior Publication Data

US 2011/0207356 A1 Aug. 25, 2011

(30) Foreign Application Priority Data

Feb. 23, 2010 (JP) ..... 2010-037856

(51) Int. Cl.
*H01R 12/24* (2006.01)

(52) U.S. Cl. ..... 439/497; 439/660

(58) Field of Classification Search ..... 439/74, 439/108, 495–498, 607.09, 607.13, 607.35, 439/607.36, 660
See application file for complete search history.

(56) References Cited

U.S. PATENT DOCUMENTS 7,074,085 B2 * 7/2006 Chen ..... 439/607.36
7,094,092 B2 * 8/2006 Yang ..... 439/495
7,220,146 B2 * 5/2007 Miyazaki ..... 439/579
7,465,186 B2 * 12/2008 Yotsutani ..... 439/497
7,722,387 B2 * 5/2010 Yamaji et al. ..... 439/497
7,815,467 B2 * 10/2010 Tsuchida et al. ..... 439/607.09
8,007,289 B2 8/2011 Bandhu et al.
8,043,114 B2 * 10/2011 Kaneko et al. ..... 439/497

FOREIGN PATENT DOCUMENTS

CN 101627508 A 1/2010
JP 2008-277020 A 11/2008

OTHER PUBLICATIONS

Chinese Office Action dated Dec. 13, 2012 (and English translation thereof) in counterpart Chinese Application No. 201110048580.8.

* cited by examiner

*Primary Examiner* — Thanh Tam Le
(74) *Attorney, Agent, or Firm* — Holtz, Holtz, Goodman & Chick, PC

(57) ABSTRACT

A connector assembly comprises a first connector and a second connector configured to be mated with each other. The first connector includes a plurality of first contacts, a first housing and a first shell. The first contacts are arranged and retained in a pitch direction by the first housing The first housing is covered at least in part with the first shell The first shell includes a spring portion and a contact portion. The spring portion extends in the pitch direction. The spring portion is long in the pitch direction. The contact portion is supported by the spring portion so as to be movable in a direction perpendicular to the pitch direction. The second connector includes a second shell. The second shell is brought into contact with at least the contact portion of the first shell so that the first shell and the second shell are connected to each other when the second connector is mated with the first connector.

19 Claims, 7 Drawing Sheets

CONNECTOR ASSEMBLY WITH GROUNDING SHIELD

CROSS REFERENCE TO RELATED APPLICATIONS

Applicants claim priority under 35 U.S.C. §119 of Japanese Patent Application No. JP2010-37856 filed Feb. 23, 2010.

BACKGROUND OF THE INVENTION

This invention relates to a connector assembly which comprises a first connector and a second connector. For instance, the first connector is configured to be mounted on and fixed to a circuit board, and the second connector is configured to be connected to a cable.

For example, this type of a connector assembly is disclosed in JP-A 2008-277020, the contents of which are incorporated herein by reference. The connector assembly of JP-A 2008-277020 comprises a connector for a circuit board (first connector) and a connector for a cable (second connector). The first connector includes a first shell. The second connector includes a second shell. The first shell is configured to be connected to a grounding portion of the circuit board. The second shell is configured to be connected to a shield wire of the cable. When the first connector and the second connector are mated with each other, the second shell of the second connector is brought into contact with at least a part of the first shell of the first connector so that the shield wire of the cable is electrically connected to the grounding portion of the circuit board via the two connectors.

The first connector and the second connector of the connector assembly of JP-A 2008-277020 have tongue pieces. The tongue piece of the first connector and the tongue piece of the second connector are connected to each other so that electrical paths between the shield wire of the cable and the grounding portion of the circuit board increase in number. However, the two shells of the connector assembly may be not sufficient in contact with each other when the connector assembly is small in size so that the shielding performance of the connector assembly may be reduced.

SUMMARY OF THE INVENTION

It is therefore an object of the present invention to provide a connector assembly with a structure which enables the two shells to be brought into contact with each other sufficiently even when the connector assembly is small in size.

One aspect of the present invention provides a connector assembly comprising a first connector and a second connector configured to be mated with each other. The first connector includes a plurality of first contacts, a first housing and a first shell. The first contacts are arranged and retained in a pitch direction by the first housing. The first housing is covered at least in part with the first shell. The first shell includes a spring portion and a contact portion. The spring portion extends in the pitch direction. The spring portion is long in the pitch direction. The contact portion is supported by the spring portion so as to be movable in a direction perpendicular to the pitch direction. The second connector includes a second shell. The second shell is brought into contact with at least the contact portion of the first shell so that the first shell and the second shell are connected to each other when the second connector is mated with the first connector.

An appreciation of the objectives of the present invention and a more complete understanding of its structure may be had by studying the following description of the preferred embodiment and by referring to the accompanying drawings.

Figure 1:
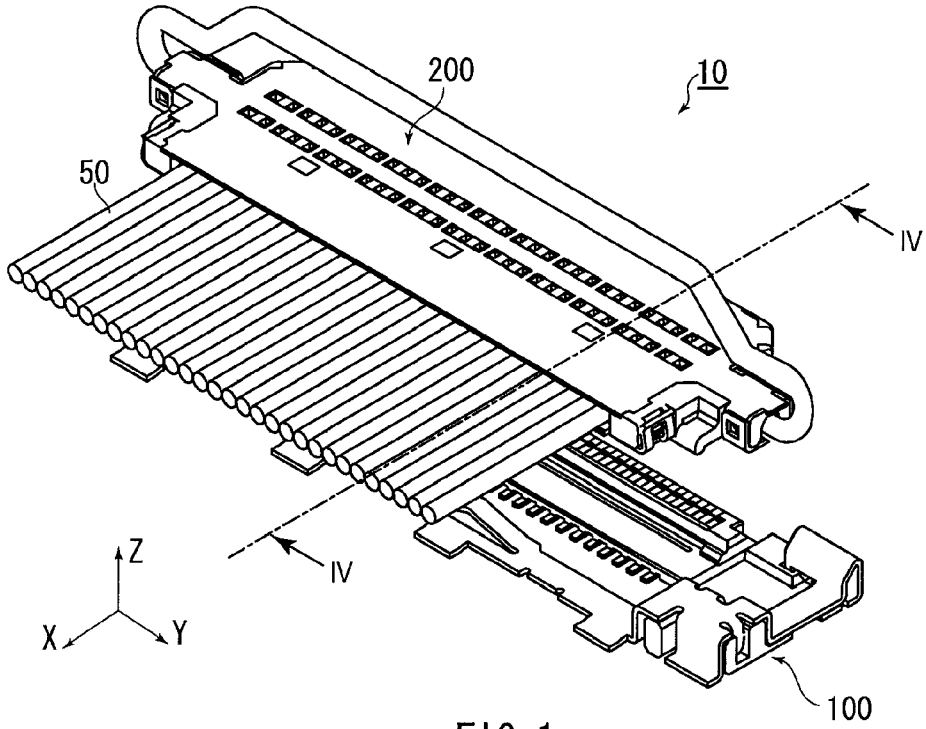
FIG. 1 is a perspective view showing a connector assembly comprising a first connector and a second connector according to an embodiment of the present invention, wherein the first connector and the second connector are separated from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 8, a connector assembly 10 according to an embodiment of the present invention has a first connector 100 and a second connector 200 which are configured to be mated with each other. The first connector 100 is an on-board connector which is configured to be mountable on a circuit board (not shown). The second connector 200 is a cable connector which is configured to be connected to a cable 50. When the first connector 100 is mated with the second connector 200, the cable 50 which is connected to the second connector 200 extends to a forward direction of the first connector 100 (to the positive X-direction) from a mated and connected part of the first connector 100 with the second connector 200.

Figure 2:
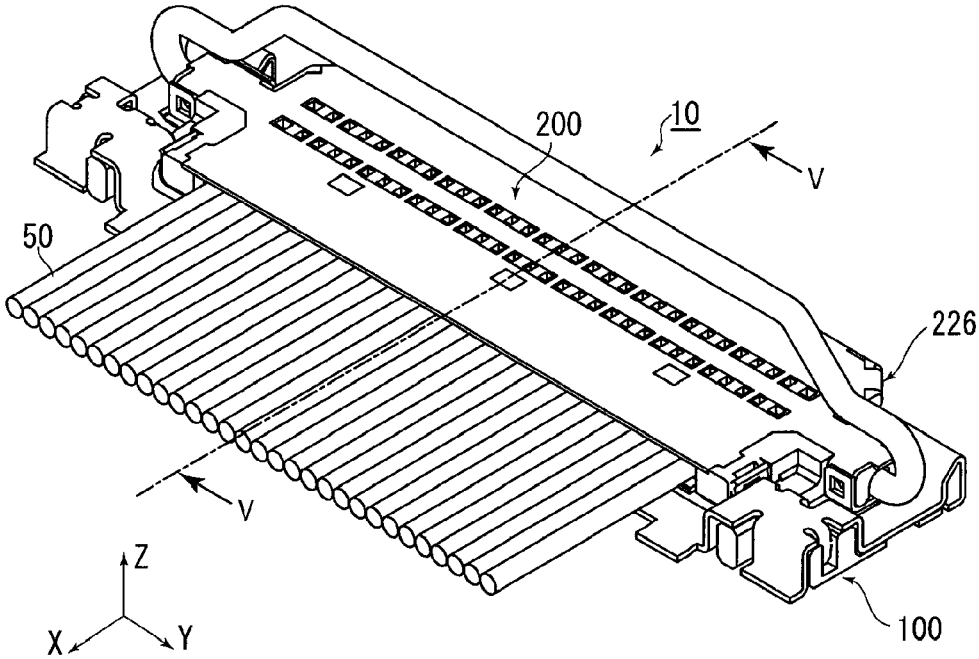
FIG. 2 is a perspective view showing the connector assembly of FIG. 1, wherein the second connector is located at a predetermined position in a vertical direction (Z-direction) and the second connector is not mated with the first connector.
Figure 3:
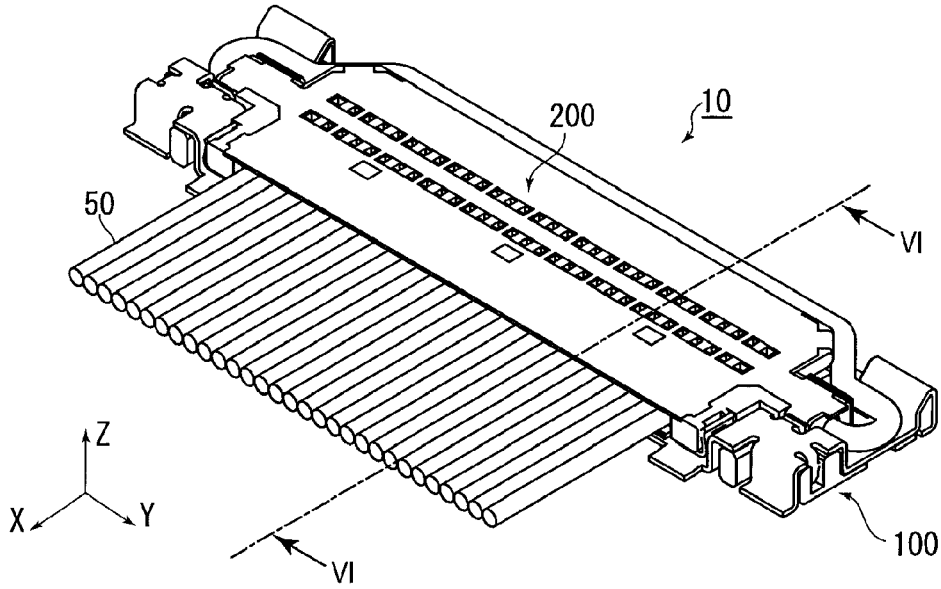
FIG. 3 is a perspective view showing the connector assembly of FIG. 1, wherein the first connector and the second connector are mated with each other.
Figure 4:
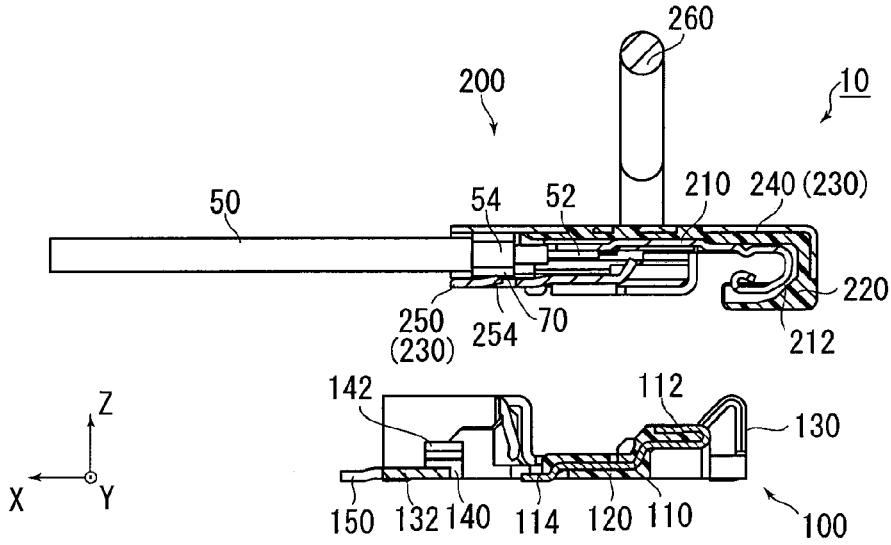
FIG. 4 is a cross-sectional view showing the connector assembly, taken along lines IV-IV of FIG. 1.
Figure 5:
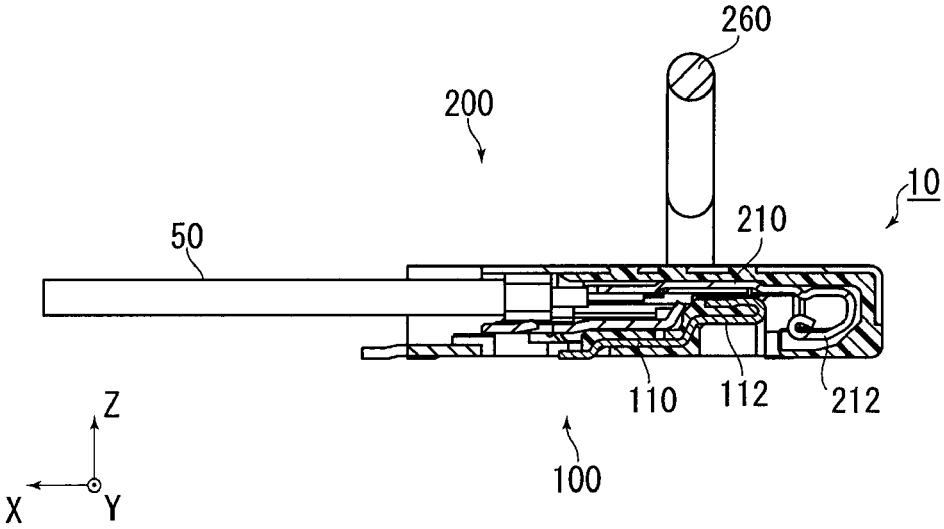
FIG. 5 is a cross-sectional view showing the connector assembly, taken along lines V-V of FIG. 2.
Figure 6:
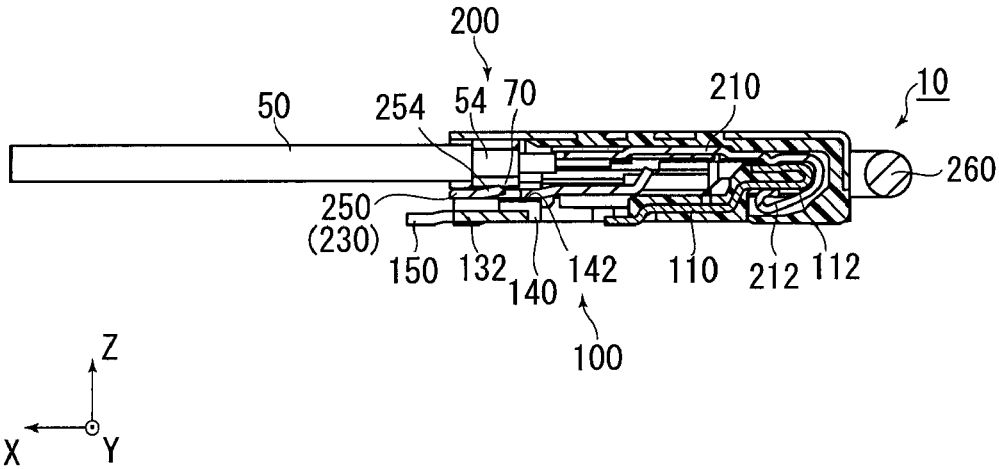
FIG. 6 is a cross-sectional view showing the connector assembly, taken along lines VI-VI of FIG. 3.

The second connector 200 shown in FIGS. 1 and 4 is located at a separated position where the second connector 200 is separated from the first connector 100. The second connector 200 shown in FIGS. 3 and 6 is located at a mated position where the second connector 200 is mated with the first connector 100. The connector assembly 10 is assembled by moving the second connector 200 on an approximately L-shaped route (i.e. in two directions successively) relative to the first connector 100 from the separated position to the mated position. In detail, as shown in FIGS. 1 and 4, the second connector 200 is located at the separated position above the first connector 100 at first. The second connector 200 is moved toward the first connector 100 (i.e. moved downwardly). As shown in FIGS. 2 and 5, the second connector 200 is brought into abutment against the first connector 100 so that the second connector 200 is located at a predetermined position in a vertical direction (Z-direction) relative to the first connector 100. Then the second connector 200 is moved toward the mated position in a horizontal direction. Especially, the second connector 200 according to the present embodiment is moved to the forward direction of the first connector 100 (i.e. to the positive X-direction) so that the second connector 200 is mated with the first connector 100 at the mated position. In the present embodiment, the predetermined position is positioned on the same level as the mated position in the vertical direction but is positioned apart from the mated position in the horizontal direction.

Figure 9:
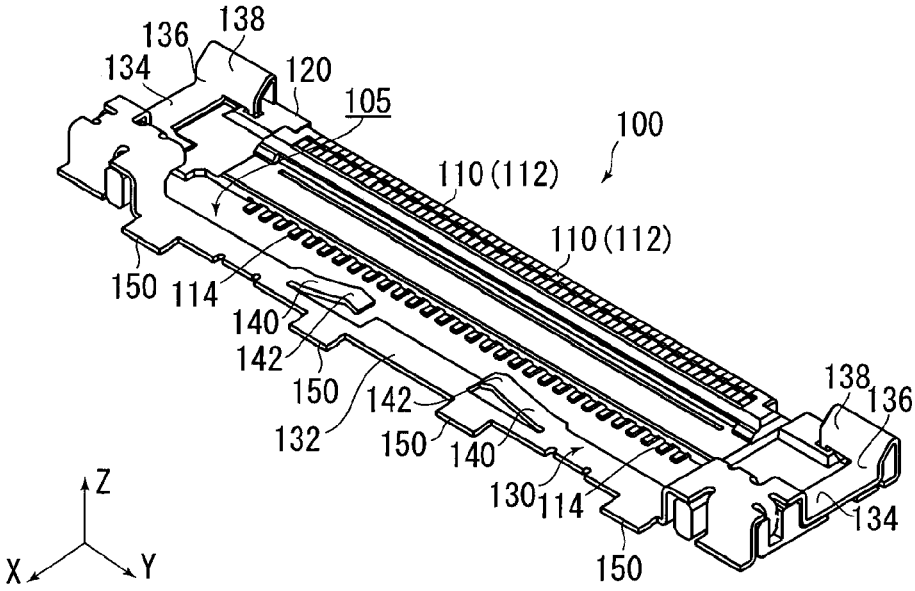
FIG. 9 is a perspective view showing the first connector of the connector assembly of FIG. 1.

As shown in FIG. 9, the first connector 100 includes a plurality of first contacts 110 made of conductive material, a first housing 120 made of insulating material and a first shell 130 made of metal. The first contacts 110 are arranged and retained in a pitch direction (Y-direction) by the first housing 120. The first housing 120 according to the present embodiment is formed by insert-molding the first contacts 110. The first contact 110 includes a first contact portion 112 and an SMT portion 114.

Figure 10:
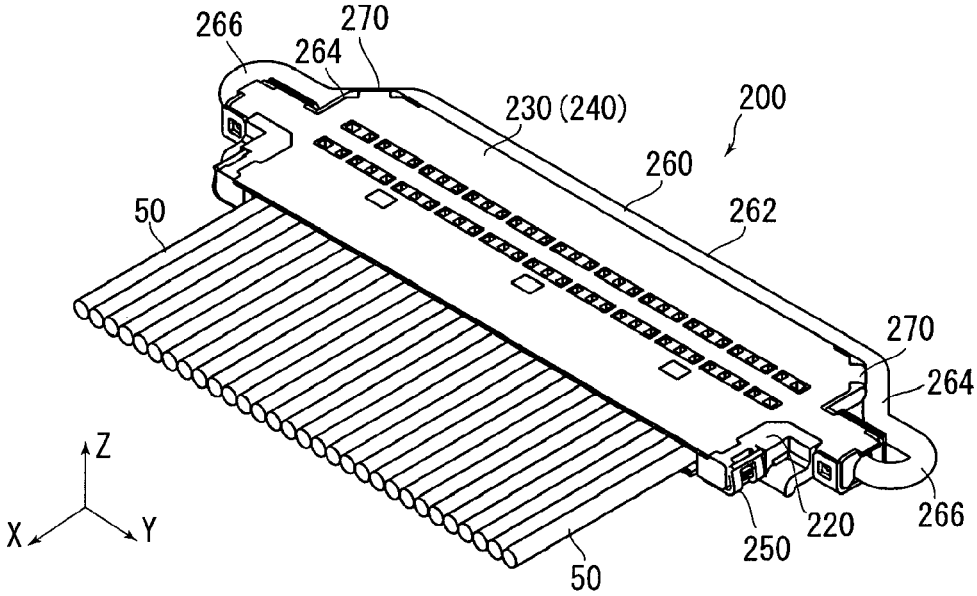
FIG. 10 is a perspective view showing the second connector of the connector assembly of FIG. 1.
Figure 11:
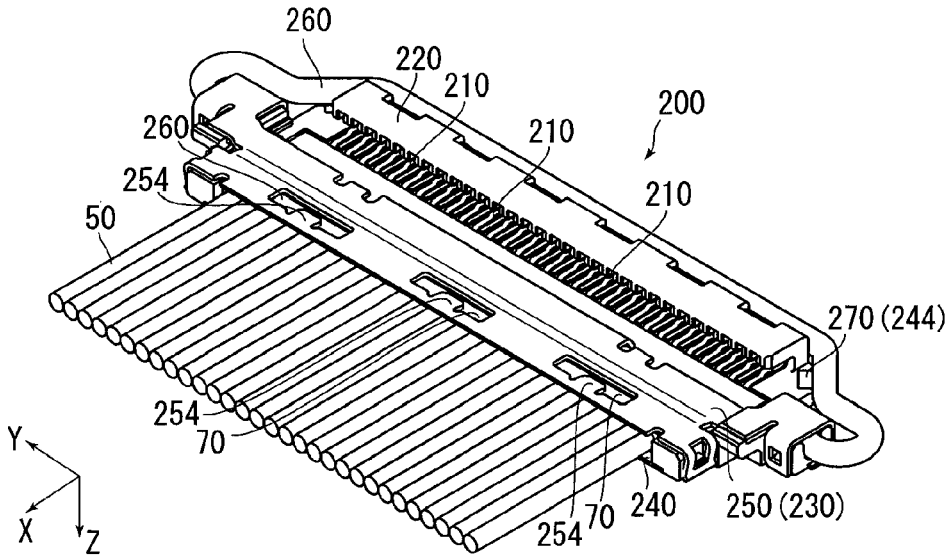
FIG. 11 is a perspective view showing the second connector of FIG. 10 as seen from a bottom of the second connector.

Referring to FIGS. 10 and 11, the second connector 200 includes a plurality of second contacts 210 made of conductive material, a second housing 220 made of insulating material, a second shell 230 made of metal and a lock bar 260 made of metal. The second contacts 210 are arranged and retained in the pitch direction (Y-direction) by the second housing 220. The second housing 220 according to the present embodiment is formed by insert-molding the second contacts 210. The second contact 210 includes a second contact portion 212.

When the first connector 100 is mated with the second connector 200, the first contact portion 112 of the first connector 100 is brought into contact with the second contact 210 (mating contact) of the second connector 200 so that the first shell 130 and the second shell 230 are connected to each other. The SMT portion 114 is connected to a signal pattern formed on the circuit board (not shown) when the first connector 100 is mounted on the circuit board. The first contact portion 112 has a U-like shaped cross-section with a curved bottom part in the XZ-plane. The bottom part of the U-like shaped cross-section faces rearward of the first connector 100 (i.e. toward the negative X-direction). The first connector 100 has a front half part and a rear half part. The first contact portion 112 is incorporated into the first housing 120 at the rear half part of the first connector 100. In other words, the first contact portion 112 is retained by the first housing 120 at the rear half part of the first connector 100. The SMT portion 114 is located in a region 105 surrounded by the first housing 120 and the first shell 130.

Figure 12:
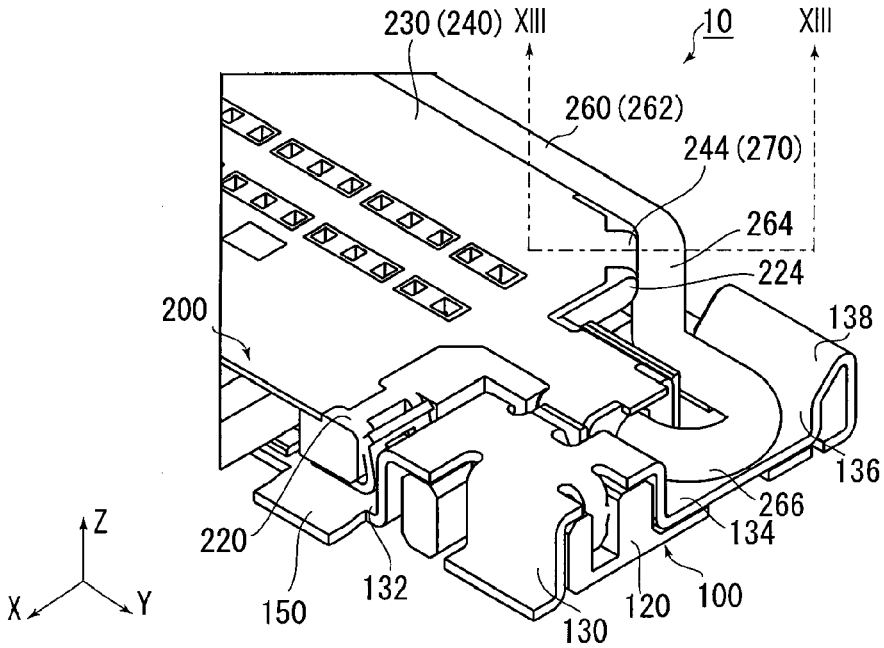
FIG. 12 is a partial, enlarged perspective view showing an end of the connector assembly of FIG. 3 in a pitch direction (Y-direction).

As shown in FIGS. 9 and 12, the first shell 130 includes a bottom plate portion 132, two side portions 134, two lock receiving portions 136 and two guide portions 138. The bottom plate portion 132 extends long in the pitch direction (Y-direction). The side portions 134 are formed at opposite ends of the bottom plate portion 132 in the pitch direction, respectively. The side portions 134 cover opposite ends of the first housing 120 in the pitch direction, respectively. In other words, the first housing 120 is covered (at least) in part with the first shell 130. The lock receiving portion 136 is formed at rear end of the side portion 134 so as to rise in the Z-direction. The guide portion 138 extends obliquely rearward from the lock receiving portion 136. The bottom plate portion 132 is mostly located at the front half part of the first connector 100. The bottom plate portion 132 is formed so that the bottom plate portion 132 faces the circuit board when the first connector 100 is mounted on the circuit board.

The lock receiving portion 136 has a flat surface defined by the Z-direction and the Y-direction. In other words, the lock receiving portion 136 has a vertical surface perpendicular to the X-direction. The guide portion 138 has a flat surface oblique to the X-direction and the Z-direction.

As shown in FIG. 9, the bottom plate portion 132 is formed with two contacts. Each of the contacts includes one spring portion 140 and one contact portion 142. The two contacts are arranged symmetrically with respect to a centerline of the first shell 130 in the pitch direction. Each of the spring portions 140 extends in the pitch direction (Y-direction). The spring portion 140 is long in the pitch direction. Each of the spring portions 140 is cantilevered by the bottom plate portion 132 so that the spring portion 140 has a free end and a fixed end. The free end is nearer to the center of the first shell 130 in the pitch direction than the fixed end. In other words, the free end is positioned between the center of the first shell 130 and the fixed end of the spring portion 140 in the pitch direction. The contact portion 142 is pressed against and connected to the second shell 230 when the first connector 100 and the second connector 200 are mated with each other. The contact portion 142 is supported by the spring portion 140 so as to be movable in a direction perpendicular to the pitch direction. Especially, the contact portion 142 according to the present embodiment is movable in the vertical direction (Z-direction). As described above, the spring portion 140 extends along the pitch direction (contact pitch direction) which is the longitudinal direction of the first connector 100 so that the spring portion 140 can be relatively long even when the first connector 100 is wholly small. Therefore, it is relatively easy to ensure the spring portion 140 to have enough elasticity. The contact portion 142 according to the present embodiment is supported by the above-mentioned spring portion 140 so that contact portion 142 is connected to the second shell 230 more securely. In other words, the first shell 130 and the second shell 230 are in more stable contact with each other so that the connector assembly 10 has a high shielding capability. The spring portions 140 are formed on the bottom plate portion 132 while the first shell 130 is not formed with a top plate portion opposing to the bottom plate portion 132 in the Z-direction so that it is possible to reduce the height of the first connector 100 in a height direction (Z-direction).

The first shell 130 is formed with a terminal portion 150 extending forward (to the positive X-direction) from the bottom plate portion 132. The terminal portion 150 is configured to be connected and fixed to a grounding portion formed on the circuit board. As shown in FIGS. 1 to 8, when the second connector 200 is mated with the first connector 100, the cable 50 which is connected to the second connector 200 extends forward from a mated part of the second connector 200 with the first connector 100. The terminal portion 150 is located in front of the bottom plate portion 132. As shown in FIG. 4, the cable 50 has a signal wire (core conductor) 52 to transmit an electrical signal and a shield wire (outer conductor) 54 to electrically shield the signal wire 52. The shield wire 54 is connected to the second shell 230 as described later when the cable 50 is connected to the second connector 200. Referring to FIG. 6, the terminal portion 150 is located near a contact part of the first shell 130 with the second shell 230 so that it is possible to electrically connect the shield wire 54 of cable 50 to the grounding portion of the circuit board via a relatively short path.

According to the present embodiment, the two contacts each consisting of the spring portion 140 and the contact portion 142 are located at well-balanced positions so as to sandwich the center of the first shell 130 in the pitch direction. Therefore, the first shell 130 and the second shell 230 can provide a well-balanced shield of electromagnetic wave in the pitch direction when the first shell 130 and the second shell 230 are connected to each other. Furthermore, the spring portion 140 and the contact portion 142 are neither formed at a side surface nor formed at an upper part of the first shell 130 but are formed at the bottom plate portion 132. In other words, the spring portion 140 and the contact portion 142 are located near a bottom of the first shell 130 so that the connected part of the first shell 130 with the second shell 230 can be located near the circuit board when the first connector 100 is mated with the second connector 200 mounted on the circuit board. The above mentioned structure also contributes to shorten an electrical path from the shield wire 54 of the cable 50 to the grounding portion of the circuit board.

Referring to FIG. 4, the second contact portion 212 of the second contact 210 has a hook-like shape. The second contact portion 212 is configured to be brought into contact with the first contact portion 112 of the first contact 110. As shown in FIGS. 2 and 5, the first contact portion 112 and the second contact portion 212 are not connected to each other when the second connector 200 is located at the predetermined position in the vertical direction (height direction or Z-direction) relative to the first connector 100. As shown in FIGS. 3 and 6, when the second connector 200 is moved horizontally from the predetermined position, the first contact portion 112 is inserted into a concavity of the hook-like shaped second contact portion 212 and connected to the second contact portion 212 so that the first contact 110 and the second contact 210 are connected to each other.

The second housing 220 according to the present embodiment holds the lock bar 260 rotatably (turnably) at the opposite ends thereof. The lock bar 260 according to the present embodiment includes a main portion 262, two retained portions 264 and two U-like shaped portions 266. The main portion 262 extends in the pitch direction (Y-direction). Each of the retained portions 264 extends from each of opposite ends of the main portion 262 in a direction oblique to the pitch direction (Y-direction). Each of the U-like shaped portions 266 extends from the retained portion 264 and is bent toward the retained portion 264 so as to have a roughly U-like shape. Each of the U-like shaped portions 266 has an end portion. The end portions of the U-like shaped portions 266 are held by the second housing 220 so that the lock bar 260 is turnable relative to the second housing 220. Referring to FIG. 12, the second housing 220 is formed with two eaves portions 224 protruding from the second housing 220 so as to face the retained portions 264, respectively. The eaves portion 224 protrudes in a direction perpendicular to the vertical direction (Z-direction). Especially, the eaves portion 224 according to the present embodiment has an edge portion 226 extending in a direction oblique to the pitch direction (Y-direction) and a front to rear direction (X-direction). As described later, when the lock bar 260 locks the mated state of the second connector 200 with the first connector 100, the edge portion 226 extends in parallel to a direction in which the corresponding retained portion 264 of the lock bar 260 extends. Generally, a force which secures two connectors to be mated with each other is reduced when the connectors are wholly small. Therefore, it is preferable that the lock bar 260 has the structure of the present embodiment so as to prevent the connectors mated with each other from being separated unintentionally and so as to avoid operational difficulties when the connectors are to be mated with each other.

The second shell 230 according to the present embodiment includes an upper shell 240 and a lower shell 250. The second housing 220 is covered at least in part with the second shell 230.

Figure 13:
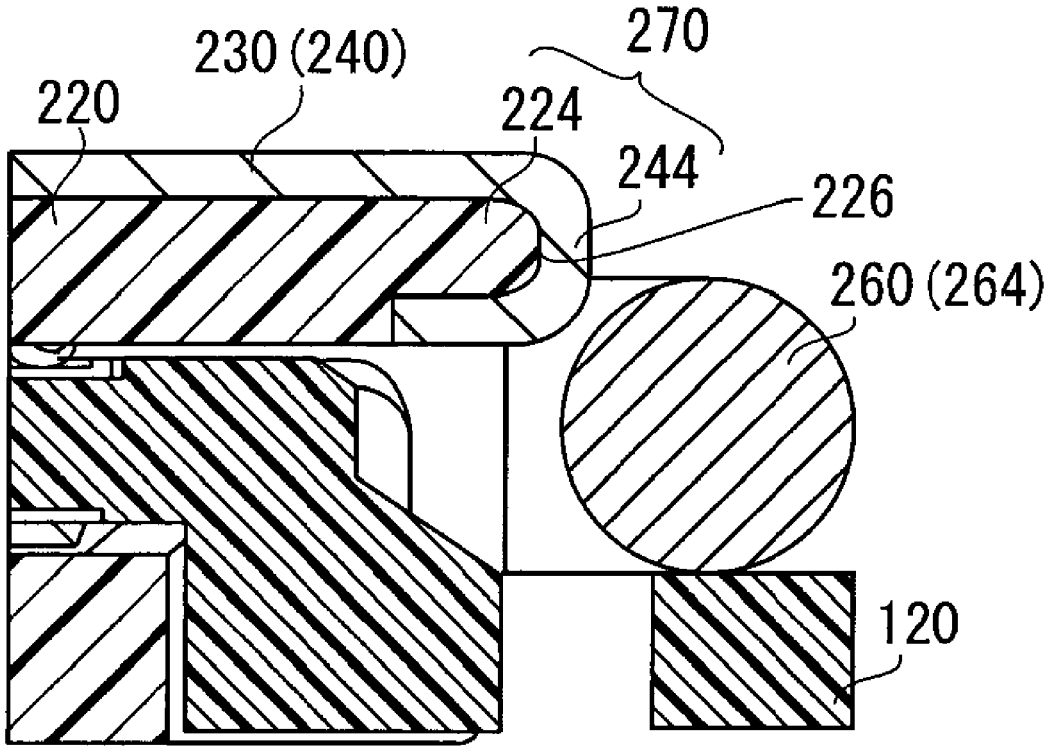
FIG. 13 is a cross-sectional view showing the end of the connector assembly, taken along lines XIII-XIII of FIG. 12.

The upper shell 240 is incorporated into the second housing 220 by insert-molding when the second housing 220 is formed. As shown in FIGS. 12 and 13, a part of the upper shell 240 is incorporated into the eaves portion 224 of the second housing 220 so that the upper shell 240 is formed with a protect portion 244. The protect portion 244 enhances a strength of the eaves portion 224. According to the present embodiment, the eaves portion 224 and the protect portion 244 form a lock maintaining portion 270. In other words, a surface of the lock maintaining portion 270 is protected in part by a protect portion 244 formed from a metal. As described later in detail, the lock maintaining portion 270 is configured to maintain the lock of the mated state by the lock bar 260.

On the other hand, the lower shell 250 is not insert-molded unlike the upper shell 240. The lower shell 250 is configured to be attached to the bottom of the second housing 220 after the cable 50 is connected to the second connector 200. In detail, the shield wire 54 and the signal wire 52 of the cable 50 are connected to the ground bar 70 and the second contact 210, respectively, so that the cable 50 is connected to the second connector 200. While the lower shell 250 is attached to bottom of the second housing 220, the lower shell 250 is connected to the upper shell 240. The lower shell 250 is formed with a soldered portion 254. The soldered portion 254 is soldered to the ground bar 70. Thus, the second shell 230 (the lower shell 250) is electrically connected to the shield wire 54 of the cable 50.

Hereinafter, further explanation is directed to a mating operation to mate the first connector 100 and the second connector 200 of the connector assembly 10 with each other as well as a locking operation to lock the mated state, with reference to the accompanying drawings.

Figure 7:
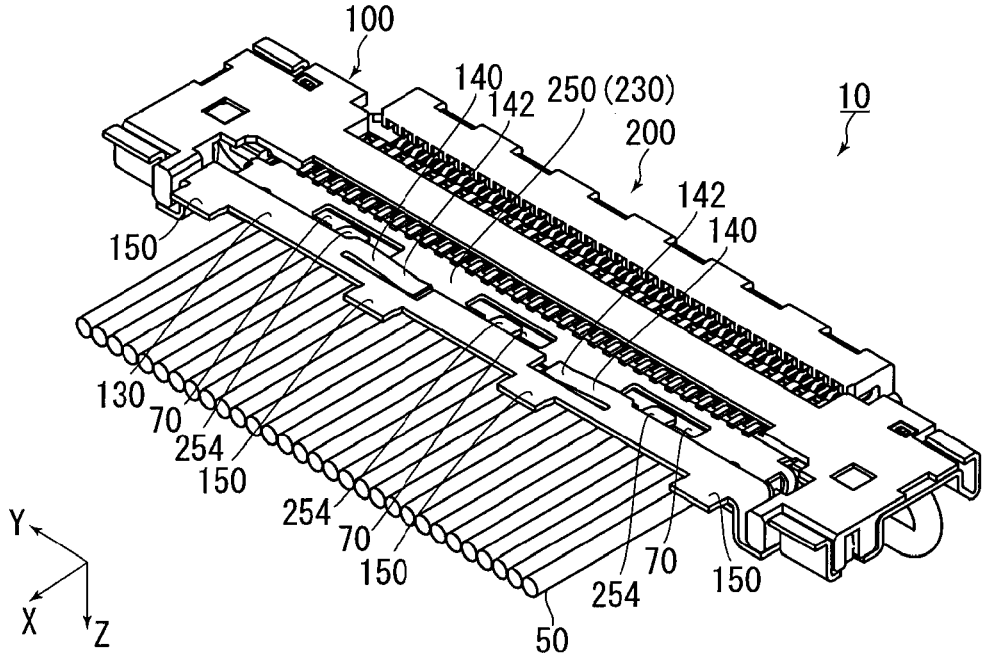
FIG. 7 is a perspective view showing the connector assembly of FIG. 2 as seen from a bottom of the connector assembly.

As shown in FIGS. 1 and 4, the second connector 200 is located at the separated position as its initial position above the first connector 100 before the mating operation. The second connector 200 is moved from the initial position toward the first connector 100 (i.e. moved downward) until the second connector 200 arrives at the predetermined position as shown in FIGS. 2 and 5. As shown in FIG. 7, when the second connector 200 is located at the predetermined position, the contact portion 142 supported by the spring portion 140 is pressed against the lower shell 250 so that the first shell 130 and second shell 230 are connected to each other.

Figure 8:
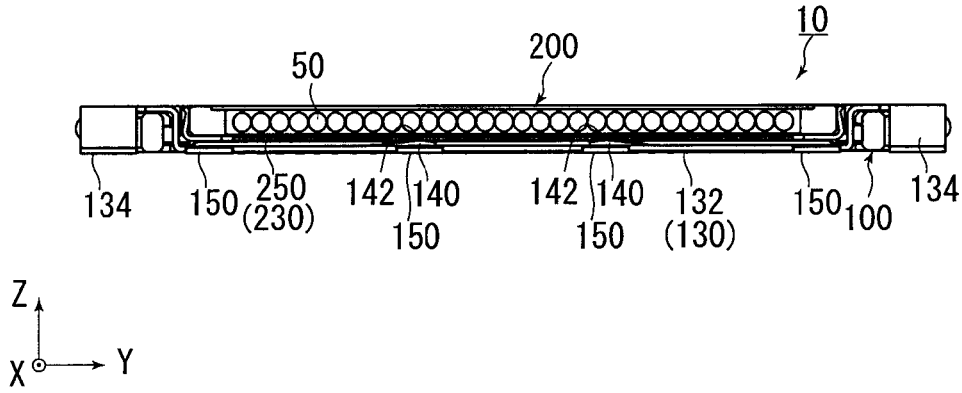
FIG. 8 is a front view showing the connector assembly of FIG. 3.

The second connector 200 shown in FIGS. 2, 5 and 7 is moved along the horizontal direction relative to the first connector 100 (specifically, moved along the positive X-direction) so that the first connector 100 and the second connector 200 are mated with each other as shown in FIGS. 3, 6 and 8. As can be seen from FIGS. 7 and 8, while the second connector 200 is moved relative to the first connector 100, the contact portion 142 according to the present embodiment slides on the lower shell 250. The spring portion 140 which supports the contact portion 142 has a sufficient elasticity so that the contact portion 142 and the lower shell 250 are kept to be in contact with each other during the sliding movement of the contact portion 142.

According to the present embodiment, the second connector 200 is moved in the horizontal direction relative to the first connector 100 by operating the lock bar 260. In detail, as shown in FIGS. 2, 5 and 7, when the second connector 200 is located at the predetermined position, the lock bar 260 is turned over backward of the first connector 100. The U-like shaped portions 266 of the lock bar 260 are brought into abutment with and are pressed against the guide portions 138 of the first connector 100 so that the second housing 220 is moved along the positive X-direction. Thus, the second connector 200 is moved in the horizontal direction relative to the first connector 100. The second connector 200 keeps on moving in the horizontal direction when the lock bar 260 is further turned over until the U-like shaped portion 266 arrives at a position where the U-like shaped portion 266 is pressed against the lock receiving portion 136 as shown in FIG. 12 (i.e. until the second connector 200 is positioned at the mated position). The U-like shaped portion 266 of the lock bar 260 is pressed against the vertical surface of the lock receiving portion 136 in the X-direction (i.e. front to rear direction which is perpendicular to the vertical direction). Then, the mated state of the second connector 200 with the first connector 100 is locked by the lock bar 260 pressed against the lock receiving portion 136.

According to the present embodiment, the lock maintaining portion 270 is formed by incorporating the protect portion 244 into the edge portion 226 of the eaves portion 224. The lock maintaining portion 270 protrudes from the second housing 220 in a direction perpendicular to the vertical direction. According to the present embodiment, the lock bar 260 is configured to be deformed temporarily before the lock bar 260 is pressed against the lock receiving portion 136 in a process of the lock bar 260 being turned over so that the retained portion 264 surmounts the lock maintaining portion 270.

As shown in FIGS. 3, 6 and 13, the retained portion 264 of the lock bar 260 is located at an obliquely-downward position from the lock maintaining portion 270 when the second connector 200 is mated with the first connector 100. In other words, the lock maintaining portion 270 is located above the lock bar 260 in a direction oblique to the vertical direction when the lock of the mated state is maintained.

Especially, according to the present embodiment, the U-like shaped portion 266 of the lock bar 260 is pressed against the lock receiving portion 136 in the front to rear direction (X-direction) so that the lock maintaining portion 270 is configured to be located above the retained portion 264 of the lock bar 260 in a direction oblique at least both to the vertical direction (Z-direction) and the front to rear direction (X-direction). More specifically, the retained portion 264 and an edge of the lock maintaining portion 270 extend in a direction obliquely both to the pitch direction (Y-direction) and the front to rear direction (X-direction) so that the lock maintaining portion 270 according to the present embodiment is located above the retained portion 264 of the lock bar 260 in a direction oblique to all of the vertical direction (Z-direction), the pitch direction (Y-direction) and the front to rear direction (X-direction).

Therefore, the lock maintaining portion 270 maintains the lock of the mated state of the second connector 200 with the first connector 100 by the lock bar 260 unless the lock bar 260 is deformed again and the retained portion 264 of the lock bar 260 surmounts the lock maintaining portion 270 to be moved back. In other words, the lock maintaining portion 270 prevents the lock bar 260 from rising up so that the lock maintaining portion 270 maintains the lock of the mated state, when the lock bar 260 is pressed against the lock receiving portion 136. Furthermore, an operator of the lock bar 260 can feel a clicking feeling which is produced by a temporary deformation of the lock bar 260 and so on when the retained portion 264 of the lock bar 260 surmounts the lock maintaining portion 270 so that the operator can easily know whether the lock is maintained or not. Especially, the retained portion 264 is harder than a spring and so on (at least does not have elasticity) and is formed to extend shortly in the direction oblique to the pitch direction. The clicking feeling is not produced when the retained portion 264 surmounts a spring formed on a shell and so on. The clicking feeling is produced when the retained portion 264 surmounts the lock maintaining portion 270. Therefore, the operator can know more easily whether the lock of the mated state is maintained or not.

The present application is based on a Japanese patent application of JP2010-37856 filed before the Japan Patent Office on Feb. 23, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector configured to be mated with each other, wherein:

the first connector includes a plurality of first contacts, a first housing and a first shell, the first contacts being arranged and retained in a pitch direction by the first housing, the first housing being covered at least in part with the first shell;

the first shell includes a spring portion and a contact portion, the spring portion extending in the pitch direction, the spring portion being long in the pitch direction, the contact portion being supported by the spring portion so as to be movable in a direction perpendicular to the pitch direction;

the second connector includes a second shell;

the second shell is brought into contact with at least the contact portion of the first shell so that the first shell and the second shell are connected to each other when the second connector is mated with the first connector;

the first connector is configured to be mountable on a circuit board;

the first shell includes a bottom plate portion, the bottom plate portion being configured to face the circuit board when the first connector is mounted on the circuit board;

the spring portion is formed on the bottom plate portion; and the spring portion has a plane parallel to a plane of the circuit board.

2. The connector assembly as recited in claim 1, wherein the first shell includes a terminal portion extending from the bottom plate portion, the terminal portion being configured to be connected and fixed to the circuit board.

3. The connector assembly as recited in claim 1, wherein:

the first connector has a front half part and a rear half part;

the first housing retains the first contacts mostly at the rear half part of the first connector; and the bottom plate portion is mostly located at the front half part of the first connector so as to be extended long in the pitch direction.

4. The connector assembly as recited in claim 1, wherein:

the first shell includes at least two contacts, each of the contacts including one spring portion and one contact portion; and the contact portions are arranged symmetrically with respect to a centerline of the first shell in the pitch direction.

5. The connector assembly as recited in claim 1, wherein the contact portion is supported by the spring portion so as to be movable in a vertical direction.

6. The connector assembly as recited in claim 4, wherein:

the first connector includes a lock receiving portion;

the second connector includes a plurality of second contacts, a second housing and a lock bar, the second contacts being retained by the second housing, the lock bar being held by the second housing so as to be turnable relative to the second housing, the second housing being covered at least in part with the second shell; and when the lock bar is turned over in the mated state of the second connector with the first connector, the lock bar is pressed against the lock receiving portion so that the lock bar locks the mated state.

7. The connector assembly as recited in claim 6, wherein the second connector includes a lock maintaining portion, the lock maintaining portion preventing the lock bar from rising up to maintain the lock of the mated state, when the lock bar is pressed against the lock receiving portion.

8. The connector assembly as recited in claim 7, wherein:

the lock bar is pressed against the lock receiving portion in a direction perpendicular to a vertical direction when the mated state is locked; and the lock maintaining portion is located above the lock bar in a direction oblique to the vertical direction when the lock of the mated state is maintained.

9. The connector assembly as recited in claim 8, wherein:

the lock bar is pressed against the lock receiving portion in a front to rear direction of the lock receiving portion when the mated state is locked; and the lock maintaining portion is located above the lock bar in a direction oblique to the vertical direction and the front to rear direction when the lock of the mated state is maintained.

10. The connector assembly as recited in claim 9, wherein the lock maintaining portion is located above the lock bar in a direction oblique to the vertical direction, the front to rear direction and the pitch direction when the lock of the mated state is maintained.

11. The connector assembly as recited in claim 7, wherein the lock maintaining portion protrudes from the second housing in a direction perpendicular to a vertical direction.

12. The connector assembly as recited in claim 11, wherein a surface of the lock maintaining portion is protected at least in part by a protect portion formed from a metal.

13. The connector assembly as recited in claim 12, wherein the protect portion is formed as a part of the second shell.

14. The connector assembly as recited in claim 7, wherein the lock bar is configured to be deformable so as to surmount the lock maintaining portion when the lock bar is turned over.

15. The connector assembly as recited in claim 6, wherein the first connector and the second connector are configured so that the second connector is mated with the first connector in such a manner that the second connector is moved along a horizontal direction after the second connector is located at a predetermined position in a vertical direction by moving the second connector to the first connector from above the first connector.

16. The connector assembly as recited in claim 15, wherein the first connector and the second connector are configured to be mated with each other in such a manner that the second connector is moved along the horizontal direction by turning over the lock bar until the lock bar is pressed against the lock receiving portion in a state where the second connector is located at the predetermined position in the vertical direction.

17. A connector usable as the first connector of the connector assembly recited in claim 1.

18. A connector usable as the second connector assembly recited in claim 1.

19. A connector assembly comprising a first connector and a second connector configured to be mated with each other, wherein:

the second connector is placed on the first connector in a vertical direction when the first connector and the second connector are mated with each other;

the first connector includes a plurality of first contacts, a first housing, and a first shell, the first contacts being arranged and retained in a pitch direction by the first housing, and the first housing being covered at least in part with the first shell;

the first connector is configured to be mountable on a circuit board;

the first shell includes a spring portion and a contact portion, the spring portion extending in the pitch direction, the spring portion being long in the pitch direction, the contact portion being supported by the spring portion so as to be movable in the vertical direction, and the spring portion having a plane parallel to a plane of the circuit board;

the second connector includes a second shell; and the second shell is brought into contact with at least the contact portion of the first shell so that the first shell and the second shell are connected to each other when the second connector is mated with the first connector.

* * * * *